US005675879A

United States Patent [19]

Nagao et al.

[11] Patent Number: 5,675,879

[45] Date of Patent: Oct. 14, 1997

[54] YARN THREADING APPARATUS FOR A DRAW TEXTURING MACHINE

[75] Inventors: Isao Nagao, Oumihachiman; Hiroshi Takada, Moriguchi, both of Japan

[73] Assignee: Murata Kikai Kabushiki Kaisha, Kyoto, Japan

[21] Appl. No.: 523,519

[22] Filed: Aug. 30, 1995

[30] Foreign Application Priority Data

Aug. 31, 1994 [JP] Japan ..... 6-230526

[51] Int. Cl.[6] ..... D02J 1/16; D02J 3/24; D02J 1/22

[52] U.S. Cl. ..... 28/272; 28/271; 28/253; 28/246

[58] Field of Search ..... 28/271, 272, 249, 28/240, 246, 253, 248

[56] References Cited

U.S. PATENT DOCUMENTS

| | | | |
|---|---|---|---|
| 2,560,341 | 7/1951 | Ham et al. | 28/272 |
| 3,095,630 | 7/1963 | Pittman | 28/253 |
| 3,284,871 | 11/1966 | Yano et al. | 28/253 |
| 3,342,975 | 9/1967 | Carr et al. | 28/249 |
| 4,236,323 | 12/1980 | Dammann et al. | 28/272 |
| 4,412,371 | 11/1983 | Hagen et al. | 28/272 |
| 4,416,041 | 11/1983 | Gujer et al. | 28/272 |
| 4,999,891 | 3/1991 | Bankar | 28/271 |

*Primary Examiner*—Bibhu Mohanty

*Attorney, Agent, or Firm*—Armstrong, Westerman, Hattori, McLeland & Naughton

[57] ABSTRACT

This invention comprises a yarn threading apparatus for a draw texturing machine for enabling yarn threading through yarn guides to be easily carried out with respect to a non-contact type heater positioned horizontally in the upper part of the machine, with a twist exerting apparatus comprising a nozzle part for supplying compressed air for transporting such yarn through a guide pipe which guides the transported yarn to the entrance of the heater and retractable guides in said heater retractable when the yarn is being threaded and insertable after the yarn is threaded for receiving a guide such threaded yarn.

15 Claims, 6 Drawing Sheets

YARN THREADING APPARATUS FOR A DRAW TEXTURING MACHINE

BACKGROUND OF THE INVENTION

1. Field of the Invention

This invention is related to yarn threading apparatus for a draw texturing machine which can easily carry out yarn threading on a header positioned in a high place for a draw texturing machine where a twisting apparatus and a heater which heats the yarn are arranged between the pair of feed rollers.

2. Prior Art

On a draw texturing machine, the first and second feed rollers maintain a yarn at a tension at which drawing is possible. Between this pair of feed rollers on the downstream side is a false twist apparatus like a nip twister which imparts a twist in the yarn. On the upstream side is a heater and cooler for carrying out heat fixing of the twist.

As a heater used in this type of draw texturing machine, a plate heater which applies heat while a heat board which is precisely controlled by a heating medium for example Dowtherm steam makes contact with the yarn is generally used. However, recently, in order to increase productivity there is a need for an increase in the speed of the yarn and for this reason the heater must be made longer. On the other hand, this brings about a need to position the heater vertically within the factory but the normal limit for the factory height, 2.5 meters, becomes the limit and at this point the increase in the yarn speed also reaches it's limit.

Also, with the type of heater arrangement as descried above, as a result of the upper end approaching the ceiling, after the yarn which is running upwards inside the heater comes out from the top end of the heater, it is lead immediately downwards and the yarn pathway is so formed that the yarn can be threaded through the twist apparatus which is placed in the upper part of the machine. Due to this, at the upper end part of the heater brings about a sharp bend in the yarn and resistance to running of the yarn, and the twist, imparted at the twisting apparatus, does not reach far enough to the heater, the desirable false twist is not carried out and breakage of the yarn also happens at this part.

As a measure to this, in place of the above described contact type plate heater, a non-contact type radiation heater which can radiate infra-red radiation at a level of 500°–600° C. higher than the melting point of the yarn is used and this proposes that the yarn can pass through the heater at high speed. By using this type of radiation heater, the total length of the heater becomes shorter. Therefore the heater can be freely positioned on a horizonal plane at, roughly, the same height as the false twist apparatus and the yarn coming out of the heater can continue in much the same way onto the twist apparatus. Also, the twist imparted at the twist apparatus directly extends into the yarn in the heater and a reliable false twist can be carried out.

The radiation heater is convenient in the points that the length of the heater can be decreased and the running path of a yarn in a false twisting section is not sharply bent. However, because the heater is placed horizontally and in the upper part of the machine frame, the yarn threading operation to the heater and introduction of a yarn to a yarn guide are difficult when the yarn threading operation is processed along the yarn running path prior to the false twisting operation.

On the machine which uses a non-contact type heater, like the sort described above, and positioned sideways, the yarn from a package supported by a creel is lead upwards, passing through the guide pipe and the first feed roller. The yarn is guided by the guide roller and turned in the direction of the false twist apparatus opposite the creel. While this yarn is being lead to the false twist apparatus, for example, a nip twister positioned above the draw texturing machine, such yarn passes through the above described non-contact heater and then the cooling device positioned at the exit of such heater.

As a non-contact type heater, several types are proposed. One is using a heating block with an internal electric heating element. In the slit, used or the yarn pathway and formed so the yarn can receive heat from the heating block, such heater has yarn-guides having yarn guide grooves at the end. Another proposed type is a tube shape heater, composed of an insulate electric filament with metal wound around the heater and which has yarn guides arranged on the lower part at a suitable spacing.

With a false twist machine using the above described non-contact type heater, when operation is to be started, or when the yarn breaks, there needs to be an operation to thread the yarn from the package on the creel to the winding package following a fixed pathway. With this yarn threading operation, with false twist machines, using non-contact type heaters, there is a heating element which becomes higher than the melt-down temperature of the yarn and is in close proximity to the yarn pathway. Therefore, it is an extremely difficult operation to freely carry out threading of the yarn through the narrow gaps in the heat without coming into contact with the heating element.

Moreover, as non-contact style heaters are arranged horizontally in a high position within the factory, they are difficult to operate and also, because there are many yarn guides in the lower part inside of the heater, these become troublesome. Furthermore, until the yarn is running at high speed and the determined yarn pathway has stabilized, the slack on the yarn can easily make contact with the heating element. If the yarn does make contact with the heating element, it melts due to there being a temperature higher than the melting point of the yarn.

SUMMARY OF THE INVENTION

Consequently, the object of this invention is a yarn threading apparatus, on a draw texturing machine, that can easily carry out threading of the yarn through a heater positioned horizontally in a high position and can also easily carry out yarn introduction to the yarn guide.

On a yarn threading apparatus of a draw texturing machine, where a twist apparatus and heater are positioned high on the machine and in order to solve the above problems, this invention comprises a nozzle member for transporting the yarn and a guide pipe for introducing the transported yarn to the entrance of the heater.

This invention is constructed in the above described way. Therefore, when yarn threading occurs, the yarn is transported into the guide pipe by the nozzle member and, as the guide pipe runs to heater entrance, the transported yarn is carried into the heater. Thus, yarn introduction and yarn threading of the false twist machine is carried out.

Also, another object of this invention is to propose a yarn threading apparatus for a false twist machine heater whereby yarn threading is easily accomplished smoothly without the yarn making contact with the heating element when yarn threading is carried out through a false twist machine heater arranged horizontally.

In order to solve the above stated object, there is a guide means arranged at the entrance to the false twist machine heater which introduces the yarn so as to keep it from touching the walls of the heater. Also there is an operation means which moves the guide roller which introduces the yarn under normal false twist machine operating times, and which moves the guide means which keeps the yarn clear of the heater walls for the false twist machine heater yarn threading apparatus at the false twist machine heater entrance.

As this invention is constructed as described above, when the yarn is passed to the heater, the guide means moves from the retracted position to the operating position. Due to the accomplishment of yarn passage, the yarn is kept from making contact with the heating element inside the heater and yarn threading is carried out easily.

DETAILED DESCRIPTION OF THE PREFERRED EMBODIMENT

Figure 1:
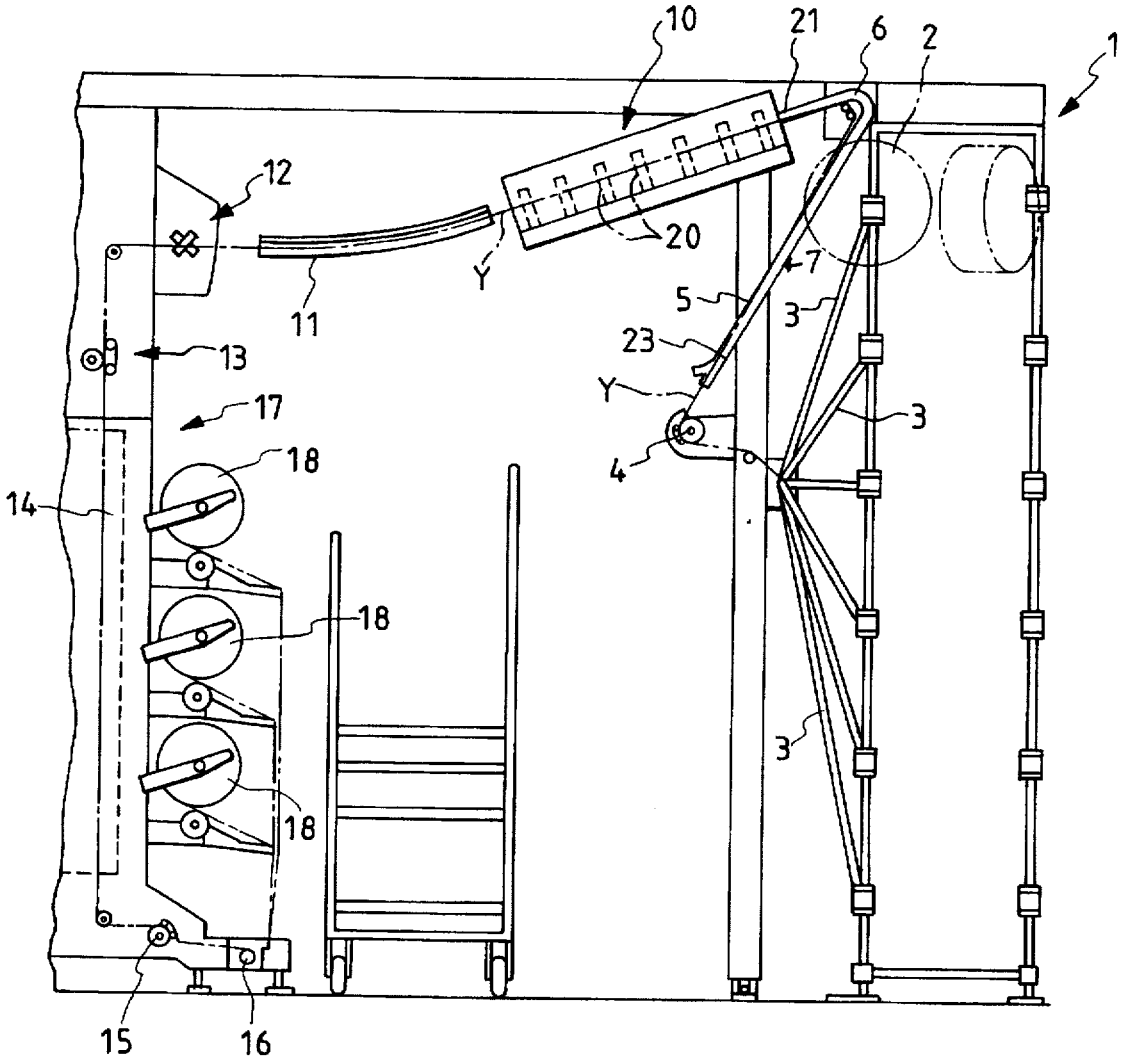
FIG. 1 is a side elevation showing the entire structure of the draw texturing apparatus as used in this invention.

The first embodiment of this invention will be explained with reference to the Figures. FIG. 1 shows the entire structure of the draw texturing machine as applicable to this invention. Yarn Y, from package 2, supported on creel stand 1, is guided by a conduit 3 and transported, at a predetermined speed, by a first feed roller 4. The yarn then passes through a guide pipe 7 formed from a straight pipe 5 and a "U" shaped pipe 6 (which will be described in detail later), or the yarn is lead to yarn guides 29, 30, FIG. 2, which are positioned on the inside curve of the "U" shaped pipe 6. Yarn Y then passes through a heater 10 and, after passing through a cooling device 11, is twisted by a twisting apparatus 12 made up of nip belts. Yarn Y is then wound onto a package 18, supported by a frame 17, after passing through a second feed roller 13, a secondary heater 14, a third feed roller 15 and an oiling roller 16.

Figure 2:
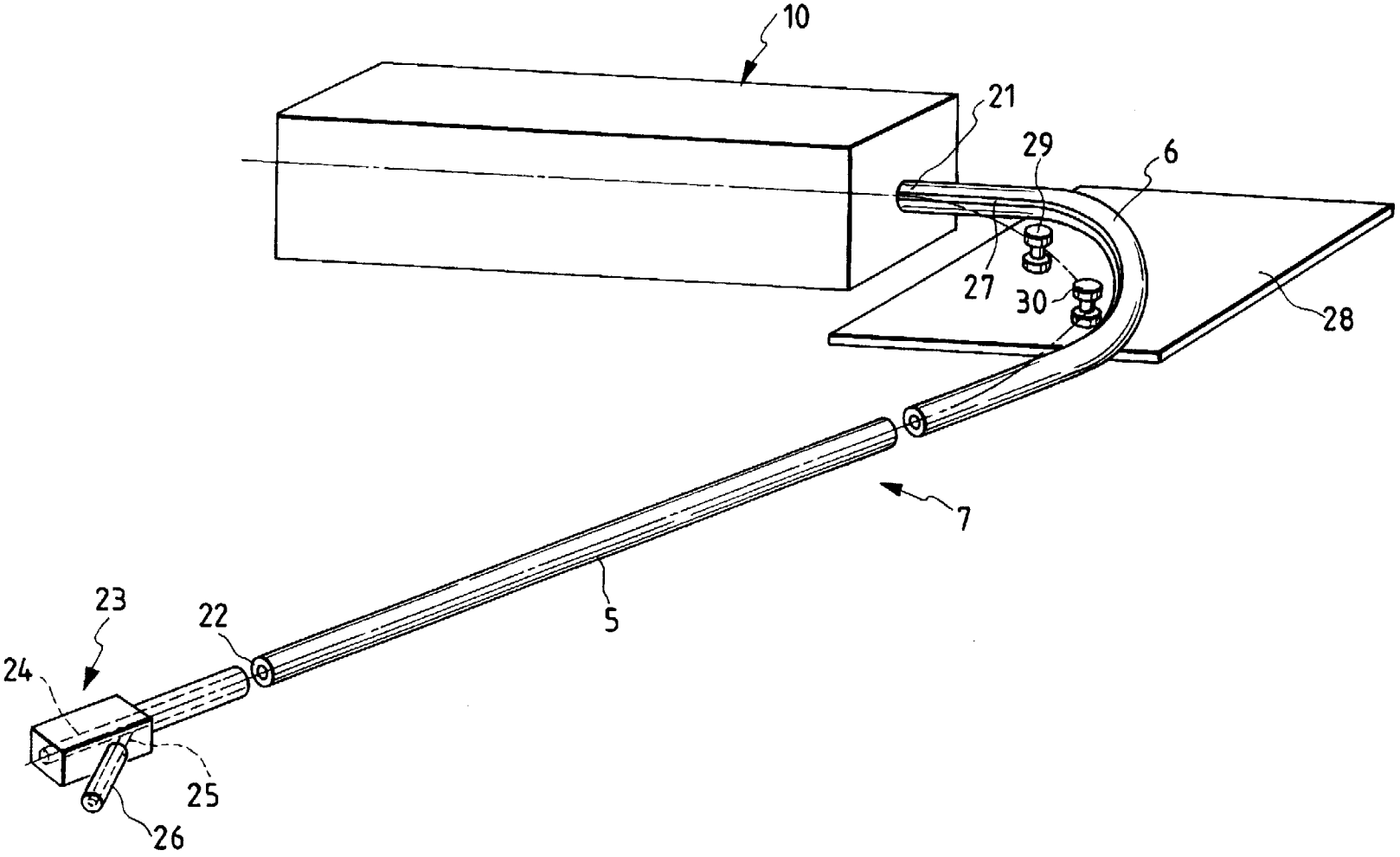
FIG. 2 is a perspective view of the first embodiment.

On the above described apparatus, between the first feed roller 4 and the second feed roller 13, the twist imparted in the yarn Y by the twist apparatus 12 extends backwards in the upstream direction of the yarn pathway until bent portion of the guide pipe 6, FIG. 1, or yarn guides 29, 30, FIG. 2, and, thus, a twist is imparted. Consequently, this twist is heat treated at the first heater 10 and then set at the cooling device 11.

The heater 10 has an infra-red radiation material contained within a cylindrical interior and is controlled to attain surface temperatures of between 300°–700° C. Every type of material has been used as an infra-red radiation material, for example ceramics like metal oxides and carbides, e.g. titanium dioxide $TiO_2$ or zirconium dioxide $ZrO_2$. Heat is applied using infra-red radiation with a wavelength of 0.78 μm–1 mm.

So as to keep the yarn, passing through the heater 10, from touching or approaching the inner wall of the heater, a plurality of guides 20, formed from a flat plate, with a slit in the center, are arranged along the longitudinal axis of the heater 10. The above described guides 20 are provided so that they are movable to a retracted position from the normal yarn pathway when yarn threading is occurring and therefore make for easy yarn threading. This heater can attain a high temperature so that, even if it is short, it is able to fully heat the yarn and, as a result, it is possible to position heater 10 about horizontally in the upper part of a frame 17 in the same way as the twist apparatus 12. Due to the twist apparatus 12, the twist is imparted directly into the yarn in the heater 10. Thus, the heater treatment of the twisted yarn, inside the heater, is stable.

As shown in FIGS. 1 and 2, between the first feed roller 4 and an entrance 21 to the heater 10, there is the guide pipe 7 composed of a straight pipe 5 and a "U" shaped pipe 6 as described previously. An air jet nozzle 23 is arranged at an entrance 22 of the straight pipe 5. This air jet nozzle 23 is formed from a tube 24 running in series with the yarn pathway and an air pressure channel 25 which blows high pressure air in the yarn running direction. A pipe 26, which injects high pressure air from the outside, is connected to an air pressure channel 25. It is possible to connect up this pipe 26 only at the times when it is needed.

There is a slit 27 on the longitudinal axis of the "U" shaped pipe 6 running down the inside of the curved part. On a plate 28, supporting this "U" shaped pipe 6, there are two ceramic yarn guides 29, 30 opposite the slit 27.

For the above described apparatus, when draw texturing is in operation and when yarn threading and yarn setting is being carried out, the yarn from the package 2, supported by the creel stand 1, is guided to the first feed roller 4 as was previously done. The end of the yarn is then positioned at the lower opening to the tube 24 of the air jet nozzle 23, and when high pressure air is blown from the air pressure channel 25 to the inside of the tube 24, the above described yarn end is sucked into the high pressure air current and is proceeds up the straight pipe 5 along with the high pressure air and to the "U" shaped pipe 6.

Due to the air current and to centrifugal force, the yarn is lead to the "U" shaped pipe 6, flows along the inner surface of the "U" shaped pipe and is guided in the same manner into the entrance 21 of the heater 10. Due to the tension of the yarn running through the center of the heater 10 with the high pressure air, the yarn running along the inner surface of the "U" shaped pipe 6 is pulled toward the center of the bent part and in the end flies out from the slit 27, situated on the inside curve of the bent part. It then is caught on the yarn guides 29, 30 positioned opposite to this slit 27. The yarn passing through the heater 10 runs along the previously mentioned yarn pathway and yarn threading occurs by a previously known method.

During normal operation of the draw texturing machine, on the guide pipe, the running yarn runs through the interior of the straight pipe 5 and in a straight line and, without touching the "U" shaped pipe is guided stabily due to the yarn guides 29, 30 on the bent part and prevents fluffing of the running yarn caused by it running along and being in contact with the inside of the "U" shaped pipe. Also, due to these yarn guides 29, 30 the twist imparted at the twist apparatus 12 is prevented from going any further up-stream and it is possible for there to be sufficient twist inside the heater.

As this invention is constructed and operates as stated above, during yarn setting operation, even if the heater is positioned high on the frame, yarn threading through the heater can be easily achieved. Also as a part of the guide pipe is so formed that it has a slit in one part, after yarn passage, the yarn can be easily guided out of the guide pipe. Furthermore, the guide pipe has a slit on the inside of the bent part and on the yarn guides which show the yarn guided out from the slit on the aforementioned bent part, after the passage of the yarn, due to the yarn tension from the guide pipe bent part, the yarn is automatically pulled out from the inside slit and automatically sets on the yarn guides. Yarn threading is easily carried out with respect to the yarn guides where damage to the yarn is less in contrast to the bent part.

Figure 3:
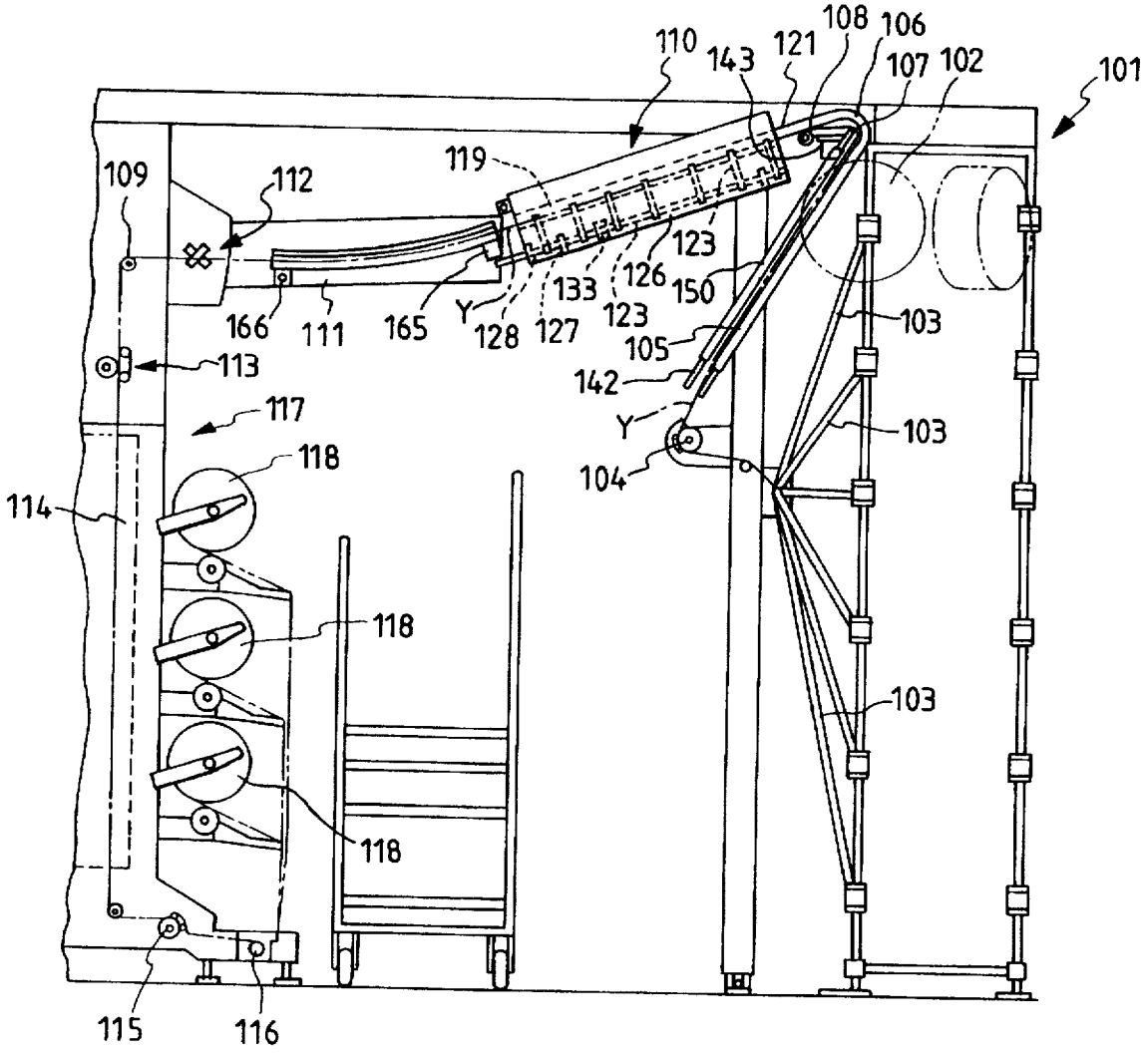
FIG. 3 is a side elevation showing the entire structure of the false twist apparatus used in this invention.

The second embodiment of this invention will be explained with reference to the Figures. FIG. 3 shows the entire structure of the draw texturing machine as applicable to this invention. Yarn Y from a package 102 which is supported by a creel stand 101 passes to a first feed roller 104 from a conduit 103. Yarn Y then passes through a straight pipe 105, a "U" shaped pipe 106 and a first guide part 107, or it is guided to a second guide part 108 (which will be described later), positioned on the inside of the bent part of the "U" shaped pipe 106, and then passes through a heater 110. After passing through a cooling device 111, a twist is imparted by a false twist apparatus 112 which is formed from intersecting belts and, via a guide roller 109, a second feed roller 113, a secondary heater 114, a third feed roller 115 and an oiling roller 116, it is wound onto one of packages 118 which are supported by a frame 117.

On the above described apparatus, between the first feed roller 104 and the second feed roller 113, the twist imparted in the yarn Y, by the twist apparatus 112, extends backwards, in the upstream direction of the yarn pathway, until the second guide part 108. Moreover, the second guide part 108 has a mirror like finish of its surface, reduces damage to the yarn and prevents the generation of scum. Due to the contact friction that exists between the yarn and the second guide part 108, there is a braking action and the twist does not spread any further away from this portion. In this way, the twist imparted in the yarn Y by the false twist apparatus 112 is first treated at the heater 110 and then fixed at the cooling device 111.

The heater 110 is a cylindrical tube heater 119 and supplies heat from the heating element wound around the outer surface of the tube. The interior of the cylinder usually attains a temperature of between 300°–600° C. and this temperature is controlled by a heat sensor not shown on the Figure. Thus, infrared radiation is radiated from the interior of the tube heater 119 and applies heat to the yarn Y running through the interior. This kind of infrared tube heater is able to use any kind of material but, in this case, ceramic like metal oxides and carbides, for example, titanium, aluminum, silicon oxide and zirconium are used. The heater uses infra-red radiation with a wavelength of between 0.78 μm–1 mm. There are a plurality of these tube heaters 119 arranged in series inside the heater 110 and heat treatment is carried out by the tube heaters 119 on the yarn of the draw texturing machines. In order to apply heat to the adjacent drawing machines, there are between 2 and 12 (maximum) tube heaters 119 arranged adjacently inside one heater box which then forms a unit.

Figure 4:
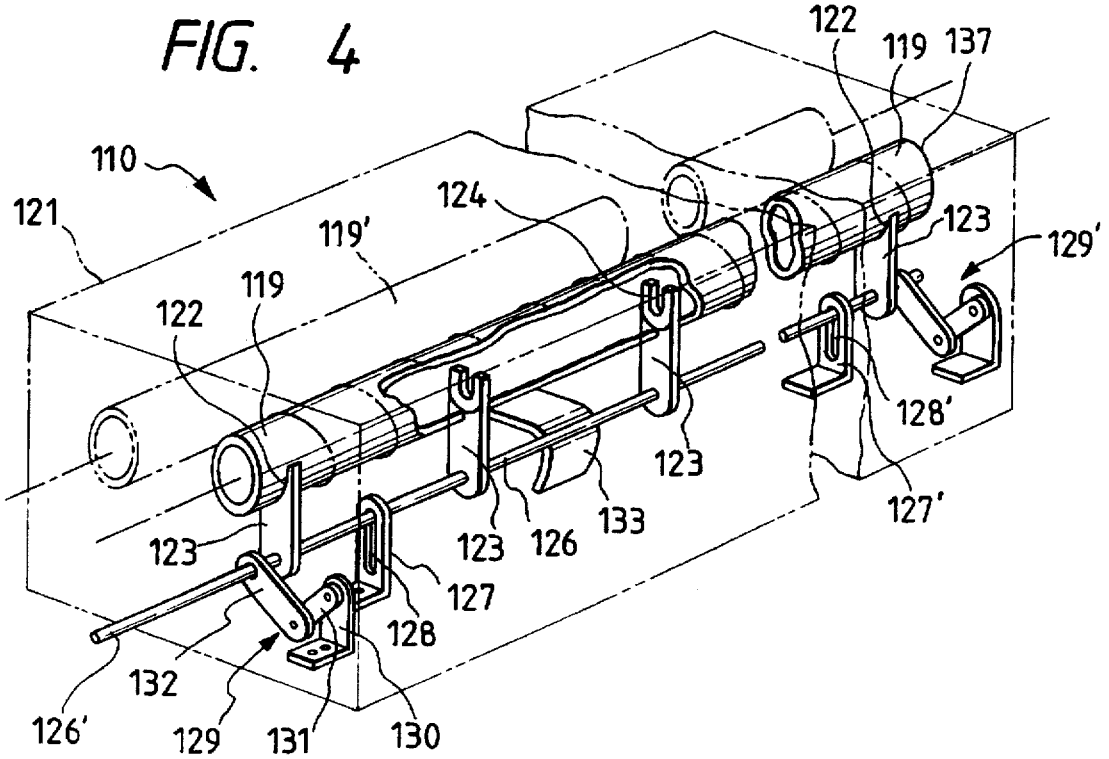
FIG. 4 is a perspective view showing an outline of the heater part of the second embodiment of this invention.
Figure 5:
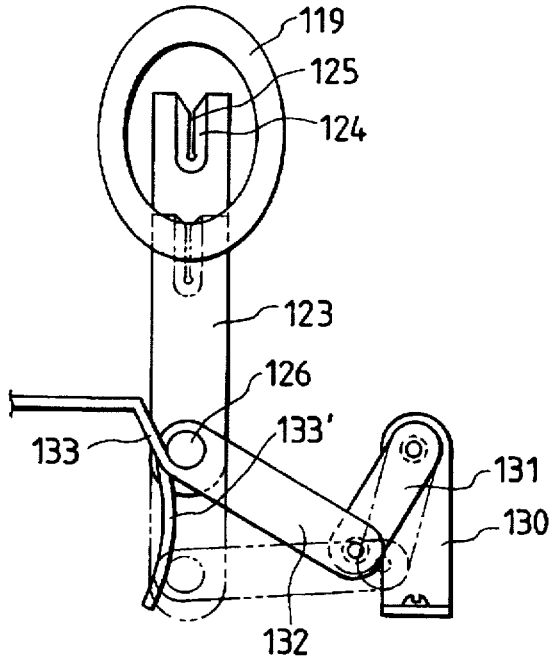
FIG. 5 is a front elevation of FIG. 4.

As summarized in FIGS. 4 and 5, the heater 110 has a number of tube heaters 119, 119' arranged adjacently within a heater box 121 and spaced at equal intervals on the bottom part of the heater 119 are holders 122. These holders 122 allow the free upwards and downwards movement of yarn guides 123. A groove is formed at the top part of the yarn guides 123 and in this groove, there is a yarn guide piece 124 with abrasive resistance made of high purity aluminum. There is a slit 125 extending from the top to the lower part of the yarn guide piece 124 and it guides the running yarn at a high speed through this slit 125.

On the lower end of each of the yarn guides 123, there is a common operating rod 126. This operating rod 126 is guided in a plurality of positions by upright elongated holes 128 in brackets 127, 127' and are supported in a plurality of positions by links 129, 129'. The link 129 is composed of a first lever 131 which rotates freely and is supported by a fixed bracket 130 and also of a second lever 132 which moves freely and is linked to the end of the first lever 131. The end of the second lever 132 supports the fixed operating rod 126 through a series of holes. The operating rod 126 is in contact with a flat spring 133 which applies a pressure towards the position of the bracket 130. A center part 133' of the flat spring 133 is convexly curved and due to this, when a protruding end 126' of the operating rod 126 is manually raised, the operating rod 126 is manually raised, the operating rod 126 moves upwards, higher than the convex center part of the flat spring 133, and is forced higher than the bracket 130 due to the flat spring 133 and is maintained in a position at the upper limit of the elongated holes 128, 128' of the bracket 127, 127'. At this time, every yarn guide 123 is at it's highest position and the lower end of the yarn guide part of the slit 125 is positioned roughly in the center of the tube heater 119. However, the height of the position of the lowest part of the slit 125 of the yarn guide 123 differs slightly for each one, a bow shape with the center of the tube heater having the highest position being the most desirable arrangement. Due to this, the yarn is prevented from vibrating within the slit when the yarn running at high speed is taken through the yarn guide part of the lowest end of the slit 125. Also, as described later, during yarn threading in the tube heater 119, when the operating rod 126 is pushed down it passes over the central convex part of the flat spring 133 and when it makes contact with the lowest point of the elongated holes 128, 128' of the brackets 127, 127', due to the downwards pressure exerted by the flat spring 133 the operating rod 126 is maintained in that position. The yarn guide 123 lowers and thus obstruction to the yarn passage operation through the tube heater 119 is prevented.

Figure 6:
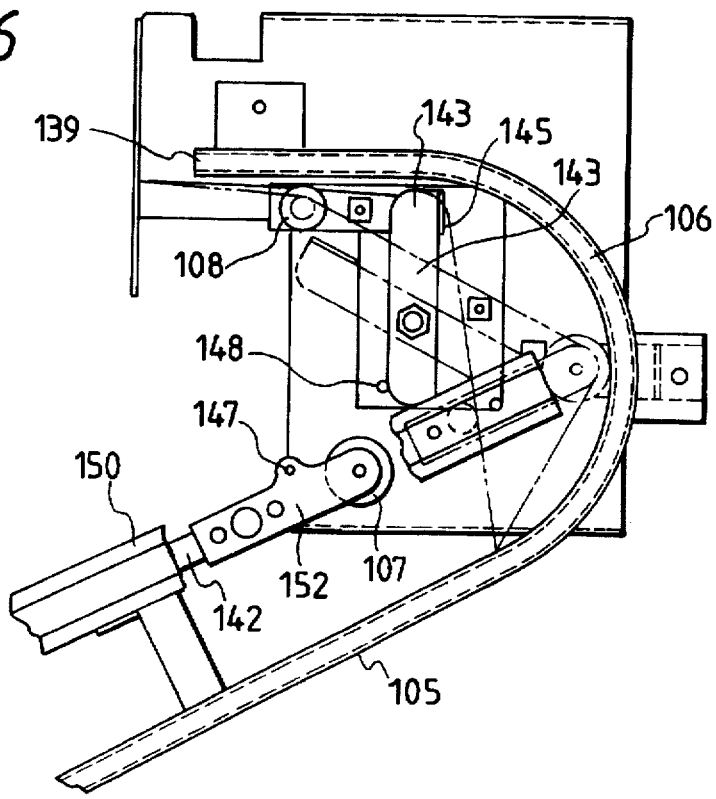
FIG. 6 is a side elevation of the guide part of the heater entrance part of the embodiment of this invention.
Figure 7:
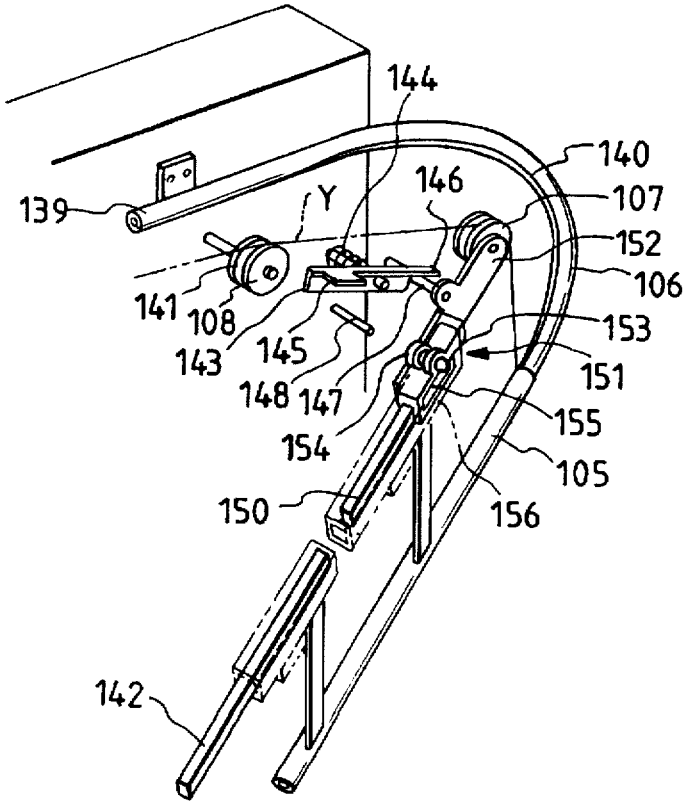
FIG. 7 is a perspective view of FIG. 6.
Figure 8:
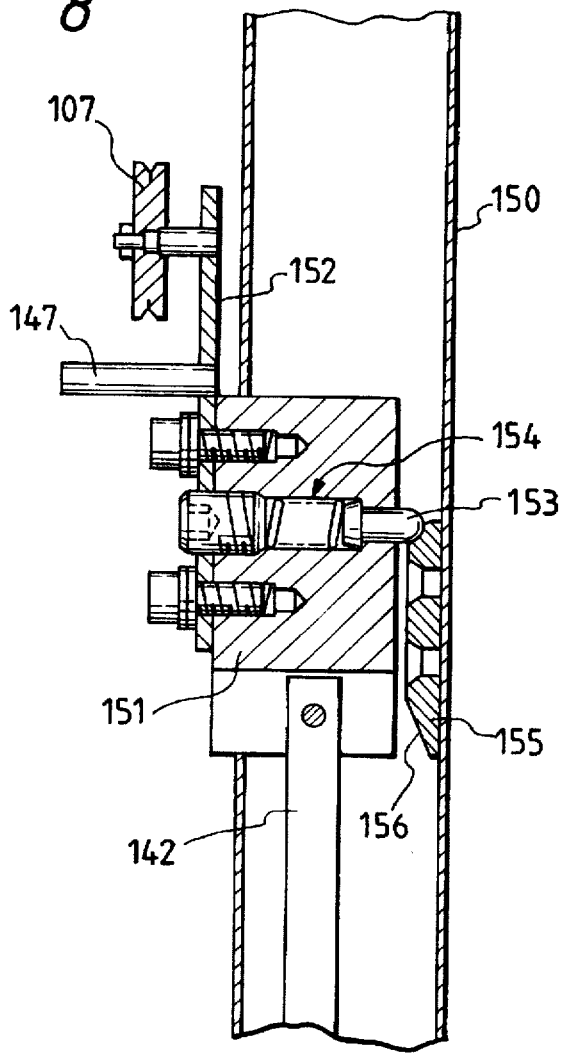
FIG. 8 is a section view of the end part of the operation rod of FIG. 6.

As shown in FIGS. 6 to 8, the yarn guide apparatus of the entrance to the heater 110 faces the entrance 137, FIG. 4, to the tube heater 119 and is arranged opposite an end opening 139, FIGS. 6 and 7 of the "U" shaped pipe fixed to the end of the straight pipe 105. On the inside of the curved part of the "U" shaped pipe, where a slit 140 is formed, there is a second fixed yarn guide 108 which has a guide surface 141 that is at about the same level as the slit 140. Also, in close proximity to this second yarn guide 108 at the entrance part to the false twist machine heater (described later), there is a swinging guide plate 143 which moves due to an operation of an operating rod 142 and which is a guidance means for keeping the passing yarn away from the walls of the heater. This guide plate 143 is so attached that, due to a return spring 144 wrapped around its axis, it generally rotates in a clockwise direction. A yarn guide part 145 is positioned on the end of the guide plate 143 and on the lower part, there is an operating end part 146 formed. As shown in FIG. 7, the operating end part 146 is pushed due to the movement of the movement pin 147 of the operating rod 142 (described later), and when the pressure from the movement pin 147 is released the operating end part 146 rotates due to the return spring 144 until it makes contact with a stopper 148. At this time, as shown in FIG. 6 by a solid line, the yarn guide part 145 of the guide plate 143 is in a higher position than the guide surface 141 of the second guide part 108. Due to this yarn guide part 145, the yarn is guided so that it is prevented from touching the inside wall of the tube heater.

A guide tube 150 is affixed in parallel to the straight pipe 105. Inside this guide tube 150 is the operating rod 142 which moves freely and on the end of the operating rod 142 is fixed an operating member 151. A plate 152 is fixed to the side of the operating member 151 and the first guide part 107 formed as a guide roller on the end of the plate 152 is supported to rotate freely. As well as this, below this plate protrudes a movement pin 147 which carries out the operation as described above. On the other side of the operating member 151 is a pin 153. This pin is arranged so that it normally protrudes out due to a spring 154 attached inside the operating member 151.

Opposite this pin 153, on the inside of the end of the guide tube 150, FIG. 8, a connector member 155 is arranged. When the operating rod 142 is pushed from a lower position to a higher position, the pin 153 sticks out at a position lower than the connector member 155 at first. As the operating rod 142 is pushed up as described above, when the pin 153 reaches the connector member 155 position, due to a lower side guide surface 156 of the connector member 155, the stop pin 153 is pushed little by little against the spring 154 and when the operating rod 142 is pushed further up, the pin 153 rides over the protruding part of the connector member 155 and attains the position as shown in FIG. 7. In this position, even if the operating rod 142 is let go, because of the connection between the pin 153 and the connector member 155, the operating rod 142 does not drop back down. On the way to reaching this position, the operating end part 146 on the lower end of the guide plate 143, which had been resting against the stopper 148, is rotated in a counter-clockwise direction against the return spring 144 due to the pin 147 and the yarn guide part 145 movement to the retracted position as shown in FIG. 7. At this time, the first guide 107 sticks out and assumes the position for normal operating for the draw texturing apparatus.

On the system, as described above, when yarn threading is carried out on the draw texturing apparatus, the operating rod 142 is pulled down and the first yarn guide 107 assumes the retracted position. At this time, because the pin 147 is also lowered, the guide plate 143 rotates until it makes contact with the stopper 148, due to the return spring 144, and thus assumes the vertical position as shown in FIG. 6. Also, when the operating rod 126 of the heater 110 FIGS. 4 and 5 is pulled down against the pressure of the flat spring 133, the operating rod 126 runs down the elongated hole of the bracket 127. Moreover, the whole of the operating rod 126 drops parallel evenly due to the links 129. When the operating rod 126 goes over the central convex part 133 of the flat spring 133, drops and hits the lower limit of the elongated holes 128, 128' of the brackets 127, 127', the flat spring 133 maintains the operating rod 126 in this retracted position. As this time, each yarn guide 123, linked by their lower ends to the operating rod 126, are pulled down together with the operating rod 126 and the upper end of the yarn guide part is withdrawn from the inside of the tube heater 119.

Figure 9:
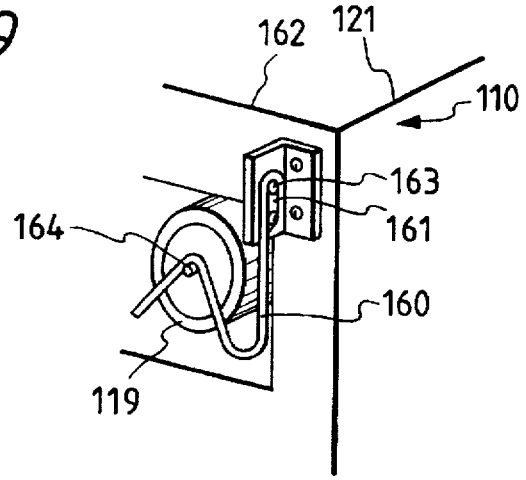
FIG. 9 is a perspective view of the guide wire part of the embodiment of this invention.

Next, as shown in FIG. 9, there is a rough "N" shaped guide wire 160 situated on the yarn exit side of the heater 110 which is attached by it's upper end to stopper member 161 which is fixed by bolts 163 to a bracket 162 which is fixed on the end of the heater box 121. The peak of the pointed part 164 of this guide wire 160 is maintained in a position roughly in the upper middle center of the tube heater 119.

Under these conditions, the end of the yarn from the packages 102 is drawn into the lower end of the straight pipe 105 and when high pressure air is blown from the lower end of the straight pipe 105 upwards, the end of the yarn is pulled by this high pressure air, raised up within the straight pipe 105, passes along the "U" shaped pipe 106 and from the exit 139 of this pipe enters the tube heater 119. The air jet nozzle of the first embodiment may be used for applying high pressure air to introduce the yarn in the straight pipe 105. At this time, the yarn passes through the slit 140 on the inside curve of the "U" shaped pipe 106, exits the "U" shaped pipe and is caught on yarn guide part 145 of the guide plate 143 which is in a vertical position. As this yarn guide part 145 is in a higher position than the guide surface 141 of the second guide part 108, the yarn does not make contact with the guide surface 141 and as it enters the inside of the tube heater 119 in this elevated position, the end of the yarn does not touch the high temperature inside wall of the entrance side of the tube heater 119 and is guided through the inside of the tube heater 119. Also, at this time, as the first guide part 107 is in the retracted position it does not come into contact with the yarn.

The end of the yarn which is introduced into the tube heater 119 is taken from the exit part and held in the air current caused by the air sucker held by the operator. At this time, the yarn end passing through the tube heater 119 does not hit the yarn guides 123, which are all in the retracted position, and is able to pass smoothly through the tube heater.

Next, on removing a stopper 165, FIG. 3, supporting the cooling device 111 and by releasing the yarn path by rotating the cooling device 111 upwards about a support shaft 166 on one end of the cooling device, the end of the yarn which is held by the air sucker passes below the released cooling device 111 and is lead to the second feed roller 113. The pressure from the friction roller of the second feed roller 113 is then released and the end of the yarn can pass between the two rollers. The friction roller then returns to its original operating position and the yarn end is nipped by the second feed roller 113. At this point, the yarn positioned at the exit of the tube heater 119 is pointing along the longitudinal axis of the tube heater 119 which points lower than the position of the second feed roller 113, thus the yarn tends to come into contact with the inside upper edge of the tube heater 119 exit wall but due to there being a wire guide 160 with a pointed part 164 positioned on the end of the heater 110, the yarn is guided and it does not come into contact with inside upper edge wall of the heater 110.

After that, the yarn between the wire guide 160 and the second feed roller 113 is lifted up on the operating end of a wire rod by the operator, passed through the released nip twister rollers which form the false twist apparatus 112 and is hooked onto a guide roller 109. Next, the nip rollers, in the false twist apparatus 112, FIG. 3, return to their original position and are in close contact with the yarn. The cooling device 111 is once more pulled down and attached to the stopper 165 and, as well as being fixed in a predetermined position, the inside of the cooling device assumes a usual operating position. Due to this, the yarn passing from the heater 110 to the second feed roller 113 is positioned along a predetermined yarn pathway. By lowering the cooling device 111 the contact between the yarn and the wire guide 160 is automatically released. When the operating rod 126 is lifted is then held in the upper limit of two elongated holes 128, 128' of two brackets 127, 127'. Consequently, within the tube heater 119, the yarn guide part of the yarn guide 123 is raised to a predetermined position and a bow shaped yarn pathway is formed by the central parts running down the longitudinal axis of the tube heater 119 and the yarn is guided into the slit 125.

When the operating rod 142 is pushed up, the first guide part 107 is pushed up while guiding the yarn which extends from the exit part of the straight pipe 105 to the yarn guide part 145 of the guide plate 143, FIG. 6. In this process, the operating pin 147, FIGS. 6 and 7, rotates the moving end part 146 of the guide plate 143 and lowers the yarn guide part 145. At this point, the pin 153, FIG. 8, positioned on the side of the operating member 151 on the end of the operating rod 142 is raised while being pushed in against a spring 154 by the inside edge of the connector member 155 of the guidance tube 150 and the part which has passed over connector member 155 sticks out, thus, not only preventing the operating rod from dropping under its own weight, but holding the first guide part 107 in a predetermined position and maintaining the guide plate 143 in the turned position against the return spring 144. At this point, the supported yarn is guided over the second guide part 108 by the guide plate 143. After that, the yarn running from the package 102 to the straight pipe 105 is put onto the first feed roller 104.

By the above operation the yarn pathway assumes a general position for the draw texturing machine and after the second feed roller 113 it passes along a previously described predetermined route, is wound onto the package 118 and normal draw texturing starts.

As this invention is comprised of the above described structure, when yarn threading is carried out on the draw texturing machine heater, there is no contact between the yarn and the heating element and yarn threading can be achieved smoothly and easily from below.

What is claimed is:

1. In a draw texturing machine which receives processed yarn unwound from a supply package and passes said yarn through a non-contact heater, a cooling zone and a twisting unit, one after the other, a yarn threading apparatus comprising means for producing an air current for transporting said yarn from said supply package to said heater and a yarn guidance means for guiding said yarn to said heater, said yarn guidance means further including guides in said heater for receiving said yarn as said yarn is introduced into said heater and guiding said yarn through said heater, for retracting said guides in said heater while said yarn is being threaded through said heater and for repositioning said guides to guide said yarn through said heater after threading is completed.

2. In a draw texturing machine which receives processed yarn unwound from a supply package and passes said yarn through a non-contact heater, a cooling zone and a twisting unit, one after the other, a yarn guiding apparatus comprising a first yarn guidance unit for introducing yarn to be threaded to an entrance of said non-contact heater and a second yarn guidance means in said heater and having guides for guiding said yarn and maintaining said yarn in a path, while passing through said heater, where said yarn avoids contact with wall surfaces of said heater, said second yarn guidance means including means for withdrawing said guides from said path while said yarn is being threaded through said heater and for returning said guides to said path after said threading is completed.

3. The yarn threading apparatus of a draw texturing machine as claimed in claim 2, wherein said heater is a tube type heater.

4. The yarn threading apparatus of a draw texturing machine as claimed in claim 2, wherein said first yarn guidance means comprises a guide pipe and means for producing an air current for transporting said yarn to be threaded through said guide pipe.

5. The yarn treading apparatus of a draw texturing machine as claimed in any one of claim 1, 2, 3 or 4, wherein said first yarn guidance means is a guide pipe having one section having a slit.

6. The yarn threading apparatus of a draw texturing machine as claimed in claim 5, wherein said guide pipe has a bent part and said slit is on the inside of said bent part and a first guide roller guides said yarn extracted from said slit on said inside of said bent part.

7. The yarn threading apparatus of a draw texturing machine as claimed in claim 2, wherein said yarn threading apparatus further comprises a first operating means for moving said second guidance means into position for guiding said yarn and for retracting said guidance means from said guiding position when said yarn is being threaded through said heater.

8. The yarn threading apparatus of a draw texturing machine as claimed in claim 7, wherein said second guidance means includes a roller for guiding said yarn to a yarn entrance part of said heater and a third guidance means for receiving said yarn from said second guidance means roller and guiding said yarn through said heater and maintaining said yarn in a position where said yarn will not contact wall surfaces of said heater when said yarn passes through said heater.

9. The yarn threading apparatus of a draw texturing machine as claimed in claim 8, wherein a second operating means moves said second guidance means roller and said third guidance means into and out of engaged and disengaged positions with said yarn.

10. The yarn threading apparatus of a draw texturing machine as claimed in any one of claim 1, 2, 3 of 4 wherein said apparatus includes twist-stopping means at a yarn entrance part of said heater for preventing continued twisting of said yarn in an upstream side of a yarn running direction.

11. The yarn threading apparatus of a draw texturing machine as claimed in claim 5, wherein said apparatus includes a twist-stopping means at a yarn entrance of said heater for preventing continued twisting of said yarn in an upstream side, of a yarn running direction in said apparatus.

12. The yarn threading apparatus of a draw texturing machine as claimed in claim 6, wherein said draw texturing machine includes a twist-stopping means at a yarn entrance part of said heater for preventing continued twisting of said yarn in an upstream side of said twist-stopping means.

13. The yarn threading apparatus of a draw texturing machine as claimed in claim 7, wherein said draw texturing machine includes a twist-stopping means at a yarn entrance part of said heater for preventing continued twisting of said yarn in an upstream side of a yarn running direction.

14. The yarn threading apparatus of a draw texturing machine as claimed in claim 8, wherein said draw texturing machine includes a twist-stopping means at a yarn entrance part of said heater for preventing continued twisting of said yarn in an upstream side of said twist-stopping means.

15. The yarn threading apparatus of a draw texturing machine as claimed in claim 9, wherein said draw texturing machine includes a twist-stopping means at a yarn entrance part of said heater for preventing continued twisting of said yarn in an upstream side of said twist-stopper means.

* * * * *